United States Patent [19]

Brooks

[11] 4,395,158

[45] Jul. 26, 1983

[54] METHOD AND APPARATUS FOR ENTRENCHING AN ENLONGATED UNDER-WATER STRUCTURE

[76] Inventor: Jerry A. Brooks, Rte. 2, Box 204, Silver Creek, Miss. 39663

[21] Appl. No.: 227,219

[22] Filed: Jan. 22, 1981

[51] Int. Cl.[3] ..... E02F 5/08

[52] U.S. Cl. ..... 405/161; 37/62; 405/159

[58] Field of Search ..... 405/158–164; 37/58, 61–63

[56] References Cited

U.S. PATENT DOCUMENTS

| | | | |
|---|---|---|---|
| 3,429,132 | 2/1969 | Martin | 405/161 |
| 3,583,170 | 6/1971 | DeVries | 405/162 |
| 3,732,700 | 5/1973 | Lynch | 37/61 X |
| 3,732,701 | 5/1973 | Lynch | 405/162 |
| 3,852,972 | 12/1974 | Holberg | 37/62 X |
| 4,117,689 | 10/1978 | Martin | 405/163 |
| 4,255,882 | 3/1981 | Verboom | 37/58 |

*Primary Examiner*—Dennis L. Taylor
*Attorney, Agent, or Firm*—Brisebois & Kruger

[57] ABSTRACT

A method and apparatus for entrenching under-water pipelines, in which auger assemblies are provided on a vehicle for inward tilting movement so that the auger assemblies both cut and convey bottom soil from the region beneath the pipeline. The respective augers are driven by hydraulic motors and can include deflectors for directing bottom soil toward the individual augers. In a variation, two sets of augers are provided on the vehicle in tandem.

14 Claims, 8 Drawing Figures

METHOD AND APPARATUS FOR ENTRENCHING AN ENLONGATED UNDER-WATER STRUCTURE

BACKGROUND OF THE INVENTION

This invention relates to a method of entrenching an underwater structure such as a pipeline, and to an apparatus for forming trenches and entrenching a pipeline in accordance with the method.

When a pipeline or cable is placed on the floor of a body of water, for example, in the Gulf of Mexico, or the floor of an ocean, it is usually required that the pipeline be entrenched or buried in the floor of the body of water. Burying the pipeline or cable is desirable for various reasons, among others, to prevent damage to the line as a result of underwater currents, and to generally prevent damage to the line from passing ships where the line is located in relatively shallow water.

Typically, the pipeline is covered with a protective casing or coating of cement and/or asphalt. While it is usual to entrench a pipeline by first laying the pipeline on the bottom of the body of water and then forming a trench under the pipeline so that the pipeline gradually sinks into the trench, the pipeline or cable could be entrenched as it is fed from a pipe laying barge.

Numerous techniques and apparatus are known for entrenching submerged pipeline or cable. Among these are rotary mechanical cutters with or without high pressure fluid jets, frequently in combination with suction dredges. Typical examples of the prior art techniques and apparatus are shown and disclosed in the following U.S. Pat. Nos.:

3,583,170
3,732,700
3,732,701
4,037,422
4,117,689

Dredges and high pressure jets, while quite effective for forming underwater trenches are expensive to operate because of the surface pumps and equipment required to operate the jets and the dredges. Further, where a suction dredge is used, the material sucked out of the trench is usually carried to the surface and then dumped with the result that any polutants on the ocean floor are mixed with the water and, in any event, the water becomes and stays muddy for a considerable period of time.

The mechanical cutters used in the past have not been wholly effective for the reason that where the floor of the body of water is silty or soft, these cutters have a tendency to cause some of the silty material to float temporarily and then settle back into the trench before the pipeline bottoms in the trench. Where rocks are encountered, the mechanical cutters are quickly dulled, and even when suction dredging is also used, the suction equipment cannot remove large rocks. Water jets are normally wholly ineffective where rocks are encountered. In the case of a bottom composed of clay, the cutters have a tendency to shear off large chunks which cannot be removed effectively with dredging equipment. Trenching with water jets when clay is encountered is very slow and time consuming because of the tenacious nature of the clay.

SUMMARY OF THE INVENTION

The method and apparatus of this invention avoids and substantially alleviates the disadvantages of the prior art techniques and apparatus.

In accordance with the invention, an apparatus is provided which trenches effectively regardless of the nature of the floor of the body of water provided of course that the floor is not solid rock. Trenching operations can be effectively done in floors composed of silt, clay, rocky deposits, or sand, or in floors or bottoms containing a combination of such materials.

While the bottom of a body of water is usually of the same consistency or composition, where long pipelines are to be trenched, changes from, for example, sand to clay or clay with rocks frequently occur.

In accordance with this invention, entrenching can proceed at a relatively rapid rate regardless of the nature of the bottom.

In accordance with this invention, trenching is accomplished by forming a generally V-shaped trench beneath the pipeline by mechanically cutting and conveying the bottom material upwardly and outwardly, with minimum agitation, so that a trench can be effectively formed under the pipeline in clay, rock containing, and sandy or silty bottoms.

In its preferred form, the apparatus uses as combined cutters and conveyors, augers which have at least partially exposed front faces for cutting, and are partly enclosed at their rear portions so that the bottom soil is both cut and conveyed by mechanical means. Upper portions of the augers are provided with surrounding casings to enhance the conveying action above the level of the bottom and these casings extend outwardly to discharge the removed materials to a location outwardly of the formed trench.

The augers are advantageously mounted on a sled or other form of underwater vehicle for pivotal movement from a vertical position in which the augers are spaced apart and straddle the pipeline, to an inwardly inclined position in which the axes of the augers intersect each other at an angle, and the cutting portions of the augers are beneath the pipeline to form a generally V-shaped trench. Further, suitable guides are provided on the vehicle to guide the vehicle along the pipeline during trenching.

In accordance with another feature of the invention, bottom portions of the augers can be exposed so that the augers can form an initial opening for themselves into the material of the bottom. This is especially advantageous where the bottom at the starting point of the trench is composed of clay or contains rocks.

The augers themselves are advantageously cylindrical, but can be conical, of decreasing diameter toward their lower ends. Such construction provides the advantage that choking or jamming of the material in the encased portions of the augers is wholly avoided. A plow or deflector can be provided in the triangular space defined by the underside of the pipeline and the inner sides of the two augers, to direct or force the material in this small triangular sector toward the augers themselves. This triangular sector, however, is normally sufficiently weakened by the action of the augers digging under and along its sides, that this section is removed without difficulty.

In accordance with another feature of the invention, the bottom of each auger is braced and has a bearing to avoid cantilever loading of the augers and to prevent excessive wear and damage to upper supporting bearings of the augers.

As a result of the upward cutting and conveying action of the augers, even large rocks, if encountered, are effectively removed by being kicked upwardly by the rotating augers. Correspondingly, rocks and stones of a size greater than the thread depth of the auger are effectively removed from the trench by this upward and outward cutting and conveying action of the augers.

In accordance with another feature of the invention, the assemblies including the augers are mounted on the vehicle for vertical adjustment to permit adjusting the apparatus to form trenches of different depths.

Another feature according to the invention is an apparatus in which the upper casings have removable front covers to permit varying the distance from the bottom of an auger assembly to an enclosing casing on the upper portion of the assembly.

A further feature is a deflector plate arrangement removably connected to each auger assembly, and which deflects bottom soil toward the inclined augers for removal.

An additional feature of the invention is an apparatus in which there are two sets of augers, one in tandem behind the other, on the same vehicle, and in which the rear set of augers removes bottom soil which may not have been removed by the front augers.

Other aspects, features, and advantages of the invention will become apparent from the drawings and the detailed description.

BRIEF DESCRIPTION OF THE DRAWINGS

While the accompanying drawings show a preferred embodiment, having the features and advantages discussed above, it is to be appreciated that these drawings relate to a typical embodiment and are not to be considered as limiting the scope of the invention.

DETAILED DESCRIPTION

Figure 1:
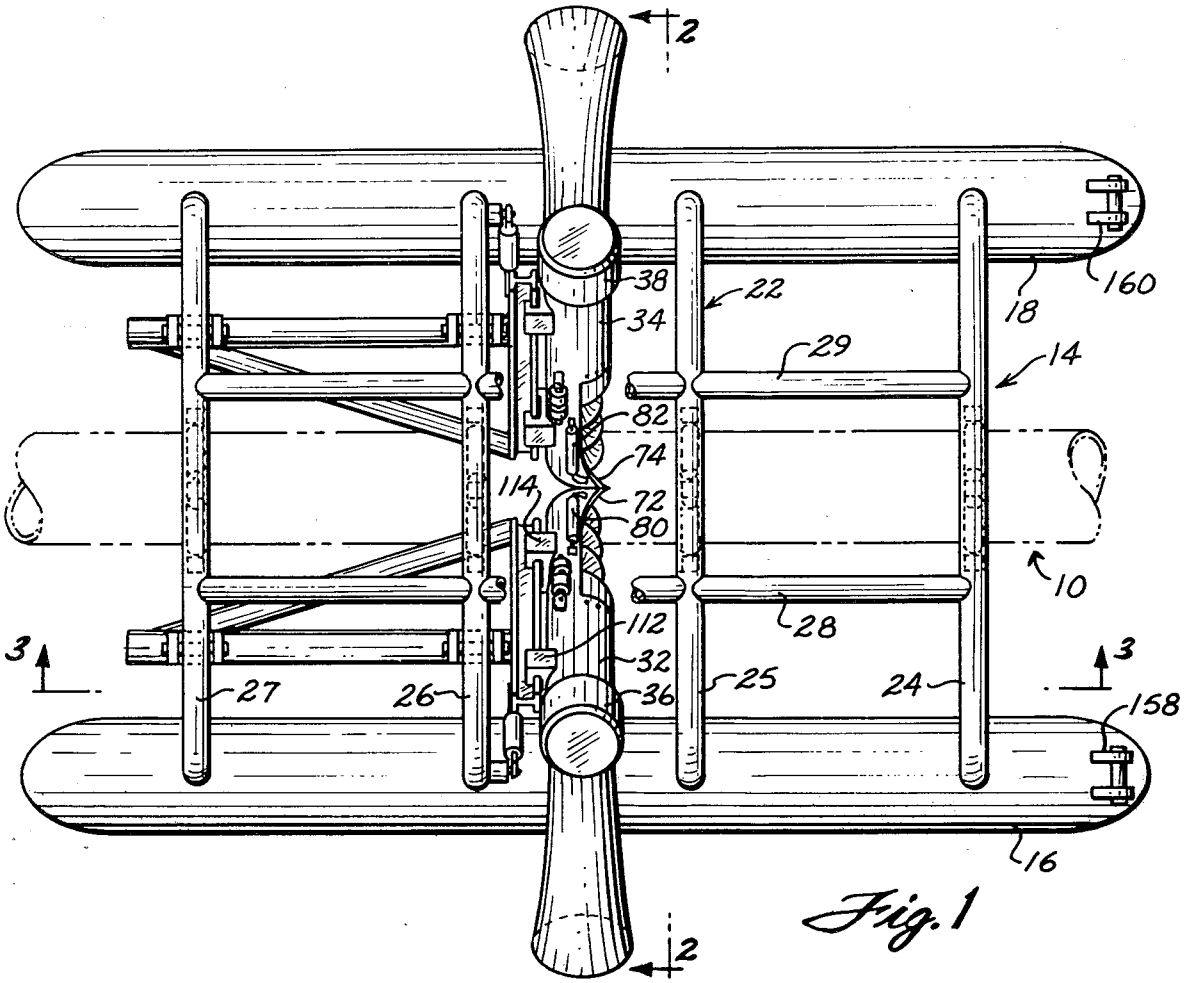
FIG. 1 is a top plan view of one embodiment of an underwater apparatus according to the invention.
Figure 2:
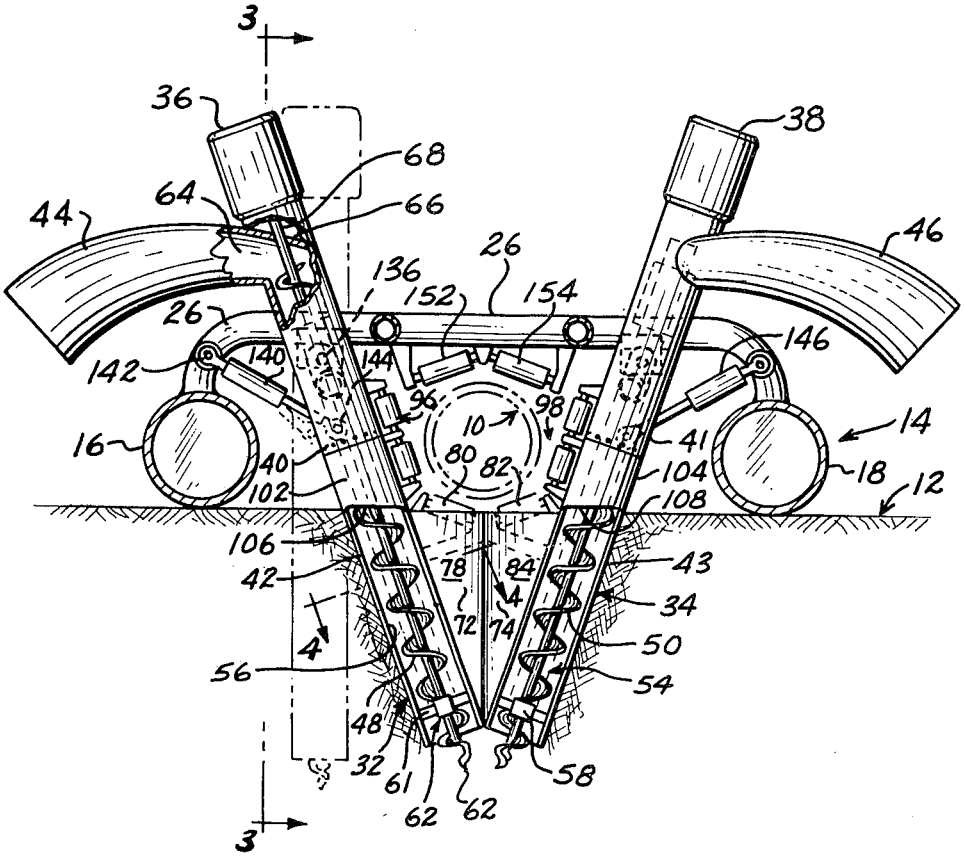
FIG. 2 is a front view in section taken along line 2—2 of FIG. 1, showing the auger assemblies of the apparatus straddling an underwater pipeline, and positioned to form a trench beneath the pipeline on the floor of a body of water.
Figure 3:
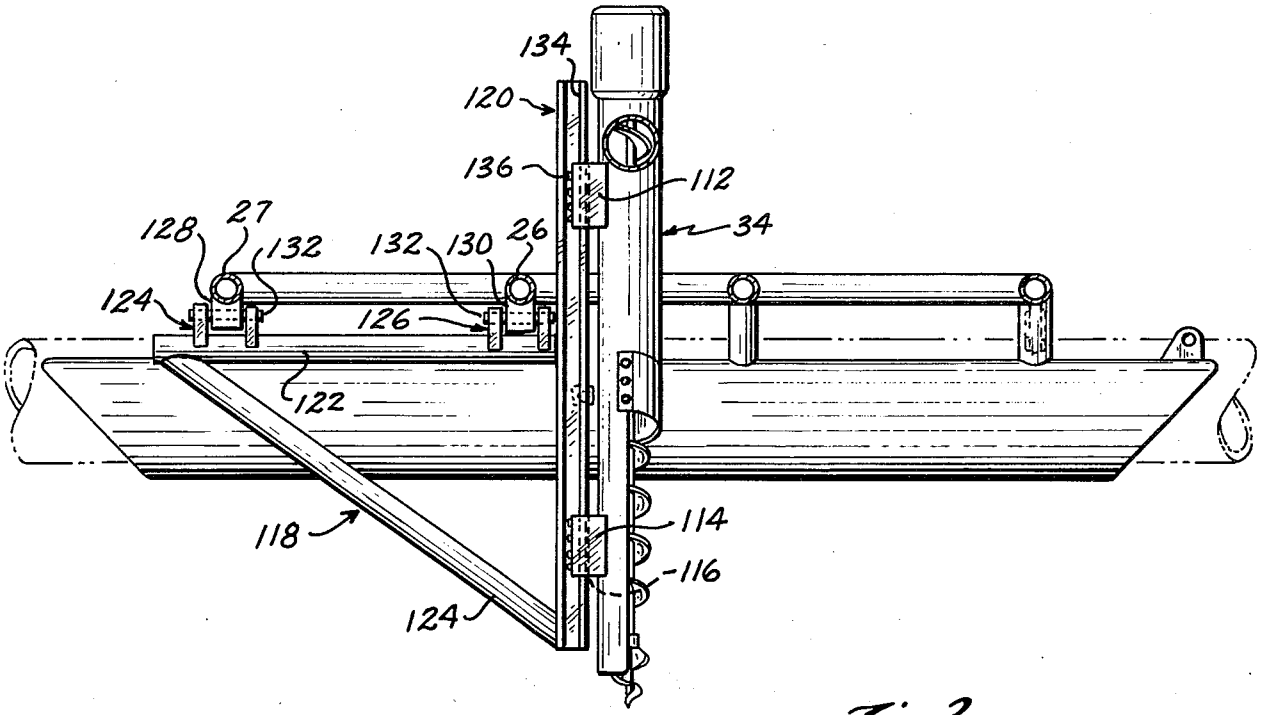
FIG. 3 is a side view in section taken along line 3—3 of FIG. 2 and showing an auger assembly with its axis vertical.

Referring now to the drawings, FIGS. 1–3 in particular, there is shown an apparatus according to the invention for entrenching a pipeline 10 in the floor or bottom 12 of a body of water. This apparatus takes the form of an underwater vehicle 14 which is shown as a sled, but which could take various other forms, such as a crawler or other form of self propelled vehicle.

Vehicle 14 in the form shown, has pontoons 16 and 18 at its opposite sides which are spaced apart a distance greater than the width of the trench to be formed. These pontoons 16 and 18 are advantageously hollow but water tight, and also serve as ballast tanks to permit ballasting the vehicle by pumping water into or out of the tanks. The pontoons 16 and 18 are connected together by the super structure 22 of the vehicle, which can take the form of inverted U-shaped laterally extending structural elements 24–27, and which provide a generally unobstructed space so that the vehicle can straddle the pipeline, as shown at FIG. 2. Longitudinal brace elements 28 and 29 extend between the respective elements 24–27 to rigidify the structure. While elements 24–29 are illustrated as pipe-like or tubular, they can of course be of any structural configuration such as I-beams, C-beams, or can be square or rectangular tubes.

Mounted on the vehicle are auger assemblies 32 and 34 forming combined mechanical cutting and conveying assemblies. These assemblies include hydraulic drive motors 36 and 38 at their upper ends, upper conveyor casings 40, 41, lower casings 42, 43, discharge casings 44 and 46, and augers 48 and 50.

Auger 48 has a left hand helical blade or flute whereas auger 50 has a right hand flute. In operation, the augers are rotated in opposite directions, i.e. auger 48 turns counter-clockwise as viewed from above, whereas auger 50 rotates clockwise as viewed from above. Such rotation in opposite directions reduces to a minimum any torques which could cause the vehicle to shift laterally on the pipeline. The cutting edge, i.e. the helical outer edge of each auger blade is preferably smooth and continuous, but can be serrated or toothed.

Lower conveyor casing 42 is cylindrical, and in the region below the surface of bottom 12 of the body of water, has its front open or cut-away so that the front of the lower portion of auger 48 is exposed. The extent of this open portion 54 of the casing is advantageously 180°, or slightly greater, thereby exposing the front of each auger for cutting. Behind this open portion 54 is a generally semicircular portion 56 of the casing.

The bottom end of lower casings 42 and 43 are each open, and the central shaft of each auger extends through a bearing 58 supported by a spider 60 having radially extending circumferentially thin arms 61 secured to lower casing 42. Of course, the flutes of the auger are discontinuous at the bearing which provides support against lateral bending of an auger, and otherwise resists cantilever forces acting on the lower portions of an auger.

The bottom end of each auger converges and terminates at a sharp cutting tip 62 which facilitates sinking the augers vertically into the bottom material. The blade such as blade 48 of each auger extends from the bottom of the auger assembly to a location adjacent an inlet 64 of discharge casing 44. Within upper casing 40, near the upper end of the auger, is a curved deflector 66 which directs material conveyed upwardly by the auger into the inlet 64 of discharge casing 44. The aguer blade 48 terminates just below deflector 66. The auger shaft 68 extends through deflector 66 and is connected to the output shaft of motor 36. An appropriate seal is provided around auger shaft 68 to prevent conveyed material from flowing to the region above the deflector 66. A bearing (not shown) is provided at the upper end of auger shaft 68.

As will soon be described in detail, each auger assembly is mounted on vehicle 14 for both pivotal movement and vertical adjustment. As shown at FIG. 2, the auger assemblies are each moveable to a generally vertical position as shown in phantom lines at the left side of FIG. 2, and to the working position shown in solid lines at FIG. 2. It will be observed from FIG. 2 that there is a generally inverted triangular space between the augers and the bottom of pipeline 10 in which the augers do not cut. To prevent material from this triangular region from passing between the augers, a deflector plate assembly 72 is secured to the lower casing of auger assembly 32, and a similar deflector plate assembly 74 is secured to the lower casing of auger assembly 34. When the auger assemblies are in their working position as shown at FIG. 2, the inner edges of the deflector plates meet in a vertical plane which extends longitudinally of the vehicle. When the augers are pivoted to the respective phantom line positions, the respective deflector plates 72 and 74 are located outwardly of the circumference of pipeline 10.

Figure 4:
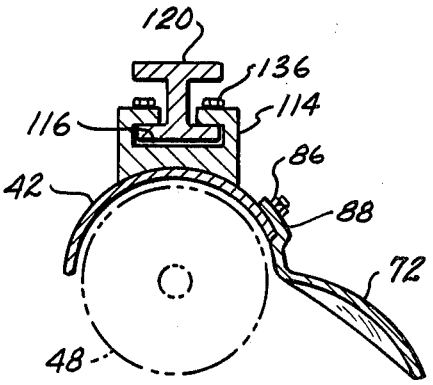
FIG. 4 is a partial view in section taken along line 4—4 of FIG. 2, showing the configuration of a deflector plate.
Figure 6:
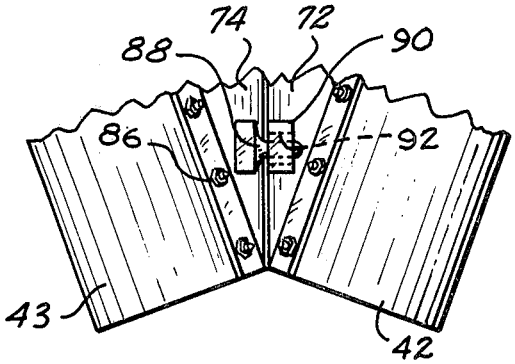
FIG. 6 is a partial rear view of the auger assemblies in their trenching position and showing the arrangement for keying the lower ends together against relative fore and aft movement.

Mounted on deflector plate 72 behind its front face 78 is a guide roller 80 which projects above the top edge of the deflector plate and is inclined inwardly toward the perimeter of pipeline 10. Another guide roller 82 is similarly mounted on deflector plate 74, behind its front face 84. These guide rollers 80 and 82 function to prevent the top edges of deflector plates 72 and 74 from engaging and thus damaging pipeline 10 or its covering. While rollers 80 and 82 are each shown as single rollers, for purposes of illustration, each of the rollers can of course take the form of a plurality of rollers which perform the desired function of preventing the deflector plates from damaging the pipeline. Deflector plates 72 and 74 are each removeably secured to the respective lower casings 42 and 43. As shown at FIGS. 1, 4 and 6, deflector plate 72 curves rearwardly from top to bottom, and also curves inwardly to direct bottom material in half triangular space between augers toward the auger 48. Plate 74 is a mirror image of 72 and directs material to auger 50. The releasable connection takes the form of a series of bolts and nuts 86. At the connection, deflector plate 72 is bent to provide an offset 88 so that the deflector plate at the connection, merges smoothly with the arcuately curved lower casing 42. The bolts of the nut-bolt assembly 86 can take the form of studs welded to the rear face of casing 42, or alternatively, can be bolts with counter-sunk heads extending into counter-sunk openings in casing 42 so that the heads of the bolts are flush with the inside surface of casing 42.

As shown at FIG. 6, a transversely extending pin 88 is fixed to the rear face of deflector plate 74, and a pin receiving block 90 is fixed to the rear face of deflector plate 72. Formed in block 90 is a vertically elongated opening 92 which extends completely through block 90 to receive pin 88 as the auger assemblies are pivoted together toward their working positions. Opening 92 extends completely through block 90 to permit pin 88 to force bottom material which may be in the opening through the block as it enters and passes through the opening. Pin 88 cooperates with block 90 to form a means for connecting or locking the lower portions of the auger assemblies together against relative movement in a direction fore and aft of vehicle 14.

As shown at FIG. 1, deflector plates 72 and 74, when the augers are in the inwardly sloped working position, meet along their inner edges to form a structure generally similar to an inverted plough. In the embodiment shown at FIG. 4, the lower casing 42 and deflector plate 72 are so formed as to enclose essentially a 180° sector of auger 48, which is located behind the auger and leaves a 180° sector of the front face of the auger exposed for cutting.

Figure 5:
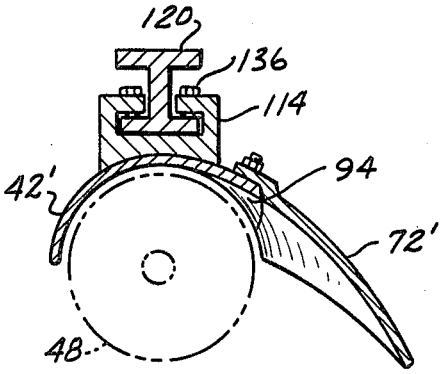
FIG. 5 is a view corresponding to FIG. 4 and showing a variation of deflector plate.

In the embodiment of FIG. 5 there is shown a deflector plate 72' connected to a lower casing 42'. In this embodiment, the lower casing 42' spans a sector less than 180° about auger 48, and deflector plate 72' is so formed that its front face merges tangentially into the inner surface 94 of lower casing 42'. In the arrangement of FIG. 5, the curvature of the front face of deflector plate 72' and inner surface 94 takes the form of a continuous smooth curve.

While the function of the embodiments of deflector plates shown at FIGS. 1–6 is to deflect bottom soil toward the respective augers from the triangular space between the augers, it is to be appreciated that, depending on the type of bottom soil, the deflector plates can either be eliminated or can simply take the form of flat plates, the function of which is to prevent bottom soil from passing to a region behind the augers where it cannot be removed by the augers. Where the bottom material is a very flowable material, the bottom soil will simply flow downwardly and outwardly so that it is removed by the exposed faces of the augers. With such flowable bottom material, it may however be desirable to simply prevent material from passing through the triangular space, in which instance a simple flat plate is all that is needed, the bottom soil in front of the plate simply flowing into the void created by the augers as they remove material from the sides of the trench.

Mounted on the rear of the respective upper casings 40 and 41 are guide roller assemblies 96 and 98, the purpose of which is to prevent the auger assemblies from engaging and damaging pipeline 10. Roller assemblies 96 and 98 have axes of rotation which are respectively parallel to the axis of rotation of the respective augers. These roller assemblies are however offset rearwardly behind the planes of the rollers 80 and 82, for a reason which will soon become evident.

The upper casings 40 and 41 each have removable front portions which take the form of generally semicircular removable casing sections 102 and 104 respectively. This type of construction in essence provides a lower section of the upper casing which is vertically split in a lateral plane. Such construction permits removing the front casing sections 102 and 104 and substituting sections of different length so that the respective bottom edges 106 and 108 of the upper casings will be just above the level of the bottom material 112, regardless of the vertical adjustment of the auger assemblies.

As shown at FIGS. 1–4, for the auger assembly 32, mounting blocks 112 and 114 are fixed to the rear outside surface of the auger casing. Formed in each of the mounting blocks 112 and 114 is a T-slot 116, and the T-slots of the blocks 112 and 114 are each parallel to the axis of auger 48 and are aligned with each other.

Each auger assembly is mounted on vehicle 14 for both vertical adjustment and pivotal movement about an axis parallel to the longitudinal axis of the vehicle. The mounting arrangement includes a mounting structure 118 which is essentially identical for each auger assembly. Mounting structure 118 includes an upright element 120 in the form of an I-beam, a longitudinal element 122 welded to the I-beam at its forward end, and a diagonally extending brace element 124 welded between the lower end of the I-beam and the rearward end of the element 122. Fixed to element 122 are clevis assemblies 124 and 126 which receive therein bearing blocks 128 and 130 respectively, and which are fixed to and extend downwardly from the respective cross elements 26 and 27 of vehicle 14. Pivot pins 132 are used to then pivotally mount structure 118 on the vehicle. The auger assemblies are in turn mounted on the vehicle by sliding the front flange 134 of I-beam 120 through the T-slots 116 of the respective mounting blocks 112. When bolts 136 of the mounting blocks are tightened, an auger assembly is fixed to the structure 118. Loosening bolts 136 provides for removing the auger assemblies by sliding them in a direction parallel to the length of I-beam 120. Further, it will be appreciated that each auger assembly can be adjusted vertically on I-beam 120, simply by loosening bolts 136 and lifting or lowering the assembly. The T-slot and I-beam arrangement further permit simply sliding an auger assembly off the I-beam flange to remove the assembly from the vehicle.

A hydraulic cylinder 140 has its cylinder end connected to cross element 26 at a pivot connection 142, and its rod end connected to I-beam 120 at a pivot connection 144. Pivot connection 144 has its axis below the axis of mounting pins 136 so that introducing hydraulic fluid under pressure into the cylinder or head end of cylinder 140 pivots mounting structure 118 and the auger assembly 32 mounted thereon to the working position shown at FIGS. 1 and 2. Introducing hydraulic fluid under pressure to the rod end of cylinder 140 pivots the auger to the phantom line position shown at line 2. Hydraulic cylinder 146 is provided for moving auger assembly 34 from its generally upright position to the inwardly slanted position shown at FIG. 2.

Projecting downwardly below cross element 26 are roller assemblies 152 and 154 which slope downwardly toward the pipeline, and the function of which is to prevent engagement of cross member 26 with the surface of the pipeline which could damage the pipeline. Rollers 152 and 154 slope toward each other so that they also guide the vehicle along the pipeline in the event that the rollers engage the pipeline. Rollers similar to rollers 152 and 154 are provided on each of the cross elements 24, 25, and 27 to prevent damage to the pipeline by any of the cross elements of the vehicle 14, and to guide the vehicle.

At the front of the vehicle on the respective pontoons 16 and 18 are clevices 158 and 160. These clevices are provided to receive a bridle (not shown) for towing the vehicle along the ocean floor with the bridle from a barge located substantially in front of the vehicle, on the surface, and directly above the pipeline. Where the vehicle is of the self-propelled type, connections will not be required to pull the vehicle, but it will still be necessary to provide hydraulic lines from a surface vessel to drive hydraulic motors 36 and 38, and conrol lines to operate cylinders 140 and 146.

OPERATION

For purposes of this explanation it is assumed that pipeline 10 is already on the floor of a body of water and is to be entrenched. The entrenching apparatus, i.e. vehicle 14 is transported to a location immediately above where entrenching will begin. The depth of the trench to be formed will be predetermined on the basis of the diameter of the pipeline and other considerations such as the depth of the water where the pipeline is entrenched. For a 36 inch diameter pipe there is usually a requirement for at least a three foot over-burden, and correspondingly, the trench formed must be six feet deep. Where more over-burden is required, deeper trenches must be formed, for example ten feet deep. In accordance with the invention, the entrenching apparatus disclosed herein can be adjusted and adapted to form trenches of different depths and can be used to entrench pipelines and other elongate underwater structures of different sizes.

Assuming that the entrenching apparatus is carried to the site of use on a barge, there will also be on the barge several sets of deflector plates 72, 74, as well as several sets of casing extensions 102, 104. There can for example be three sets of deflector plates 72, 74, one set for use in forming a six foot trench, one set for use in forming an eight foot trench, and one set for use in forming a ten foot trench. These deflector plates will have approximate vertical heights of six feet, eight feet, and ten feet, respectively. The sets of casing covers 102, 104 will then differ in length by a distance of two feet so that the bottom edge of the casing cover will be approximately at the level of the bottom soil when the auger assemblies are in their working position as shown at FIG. 2.

The embodiment of FIG. 2 illustrates the arrangement of the apparatus for forming an eight foot deep trench. Deflector plates 72 and 74 have a height of approximately eight feet and casing covers 102 and 104 are about two and one half feet in length as measured axially of an auger. Where the trench formed is ten feet deep, ten foot high vertical deflector plates would be used and the casing covers would be perhaps only several inches in height and would simply function as replacable wear plates on the upper casing. On the other hand, where a six foot trench is formed, deflector plates 72 and 74 would be six feet high and casing covers 102, 104 would each be about four and one half feet long.

After a selected set of deflector plates and casing covers are bolted onto the auger assemblies, bolts 136 are loosened, and each auger assembly is adjusted vertically on its supporting I-beam 120 to an appropriate elevation relative to the vehicle so that the bottom edges 106 and 108 of the casing covers will be at approximately the level of the surface of the bottom soil when the augers are in their working positions of FIG. 2. With the entrenching apparatus so adjusted and assembled, hydraulic lines to drive motors 36 and 38 are connected between the barge and the vehicle, and control lines are also connected to control the operation of the cylinders 140 and 146 for tilting auger assemblies 32 and 34.

While on the barge, the vehicle will be carried in a suitable cradle, and cylinders 140 and 146 will be pressurized at their rod ends to maintain each auger assembly in a generally vertical position as shown in phantom lines at FIG. 2 for auger assembly 32.

Next, the vehicle will be lowered to the bottom of the body of water to a position in which the pipeline is aligned between the still vertical augers. The vehicle will then be further lowered until the pontoons 16 and 18 are supported on the bottom surface 12. During such final lowering, depending on the nature of the bottom material, augers 48 and 50 can be rotated to plunge the auger assemblies into the bottom material. Next, the head ends of cylinders 140 and 146 are pressurized to urge the augers to the inwardly inclined working position as shown at FIG. 2. Depending on the nature of the bottom material, it may be necessary to pull the vehicle forward while rotating the augers and maintaining pressure in the head ends of cylinders 140 and 146 to enable the augers to ultimately swing to the FIG. 2 position. Where a relatively hard bottom material is encountered, it may be necessary to form a short length of trench beneath the pipeline, using jetting equipment which is normally carried by the barge.

With the entrenching apparatus in its working position, vehicle 14 is pulled along pipeline 10 while augers 48 and 50 are rotated. The speed of rotation of the augers will depend on the nature and consistency of the bottom material. Where the bottom material is relatively soft, such as "sugar sand," a relatively high rotational speed is required to cut and convey the sand upwardly and direct it outwardly through discharge chutes 44 and 46. It will be appreciated that during cutting and conveying, water is also conveyed so that the material within the upper casings, such as casing 40, is more or less in the form of a slurry.

Where the bottom material is of a harder consistency such as clay, a lower speed of rotation is desirable to cut the clay, the relatively large pieces formed by such cutting being easily conveyed by the auger to the discharge chute which it will be noted, slopes downwardly from the augers in the working position.

It will be appreciated that the mounting assembly 118 takes the form of a triangular structure, and that the I-beam 120 of this structure tends to reinforce the auger casings against fore and aft bending when the augers are in operation. Further, the brace 124 of structure 118 has the effect of reinforcing the I-beam 120 against fore and aft bending. In addition, when the augers are pivoted to their inclined working positions, pin 88 of deflector 74 enters slot 92 of block 90 to key the auger assemblies together against relative fore and aft movement at their lower ends. In this way, the auger assemblies reinforce each other against the effects of bending forces which can occur if a hard object is encountered by the augers. One or more additional pin and slot assemblies can be provided along the vertical height of the rear faces of the deflector plates to further key the deflector plates together and thus avoid the effects of forces tending to cause rearward bending.

Figure 7:
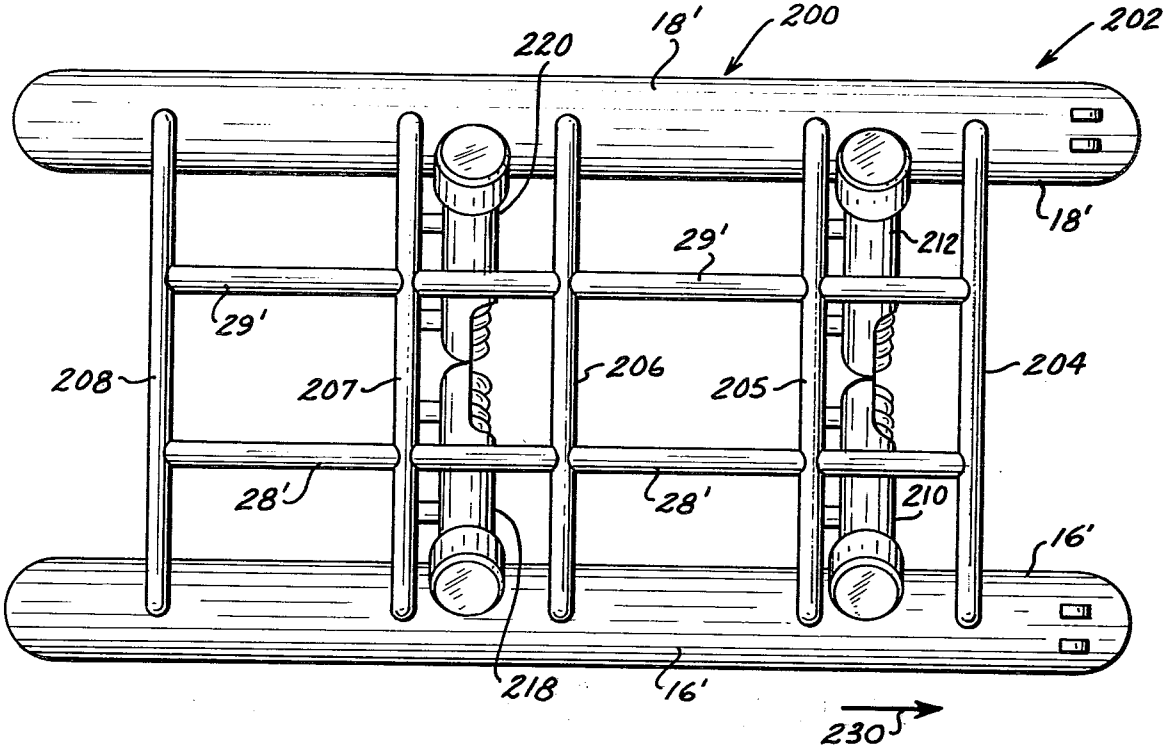
FIG. 7 shows schematically, a variation of the apparatus of FIG. 1 and in which there are two sets of augers.
Figure 8:
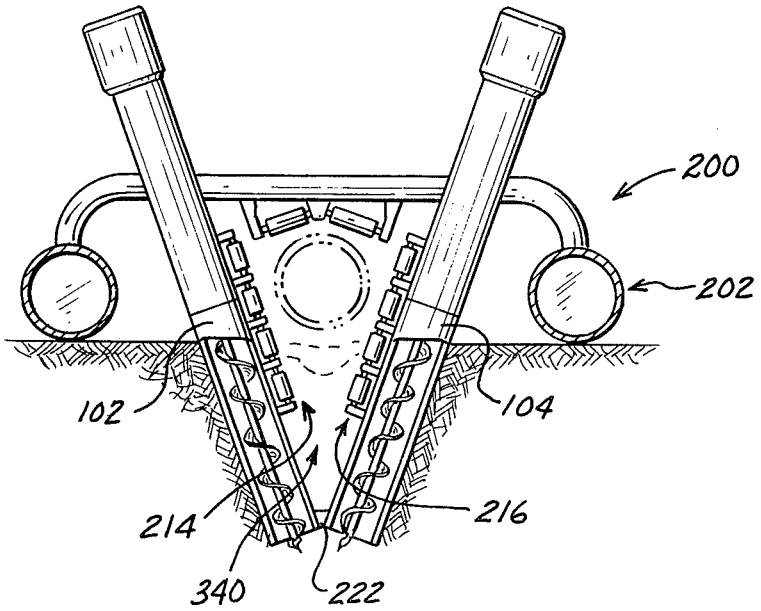
FIG. 8 is a front view in elevation of the apparatus of FIG. 7.

FIGS. 7 and 8 show a second embodiment of entrenching apparatus according to the invention. Entrenching apparatus 200 is in many ways similar to the entrenching apparatus of the embodiment of FIGS. 1–6 save that it includes two sets of augers mounted in tandem on a vehicle 202. Vehicle 202 includes pontoons 16' and 18', a plurality of spaced-apart cross members 204–208, and longitudinal structural elements 28' and 29'. The front auger assemblies 210, 212 are essentially identical to auger assemblies 32 and 34 and include replacable front casing covers 102 and 104, but as will soon be explained, deflector plates 72, 74 are not used in this embodiment. Further, auger assemblies, 210 and 212 each have a series of guide rollers 214 and 216 which extend along a substantial length of the auger assemblies as shown at FIG. 8. Individual ones of the rollers comprising these roller assemblies are detachably connected to the respective auger assemblies. Rear auger assemblies 218 and 220 are identical respectively with auger assemblies 210 and 212.

Each auger assembly is mounted on the vehicle by means of a mounting structure (not shown in FIGS. 7 and 8 but which is identical to the mounting structure 118 previously described and which is shown at FIG. 3.)

In the embodiment of FIGS. 7 and 8, a pin and slot assembly 222 can be provided adjacent the bottom end of the respective auger assemblies to key the auger assemblies against relative fore and aft movement when they are in the working positions shown at FIGS. 7 and 8. Assembly 222 is essentially the same as that shown at FIG. 6 save that the pin and block are mounted directly on the auger casing rather than the deflector plates which are not used.

OPERATION—EMBODIMENT FIGS. 7 AND 8

Use and operation of entrenching apparatus 200 of the embodiment of FIGS. 7 and 8 is similar to that previously described for the embodiment of FIGS. 1–6.

Each auger assembly is adjusted on its I-beam 120 to a position to form the trench of the desired depth. Casing covers 102, 104 of a proper length for the depth of the trench to be formed are then selected and bolted to both the front and rear auger assemblies. The auger assembly tilting cylinders are then actuated to place each auger assembly in a vertical position.

Next, the vehicle 202 is lowered so that both the front and rear augers straddle the pipeline. Next, the augers are tilted inwardly to the working positions shown at FIGS. 7 and 8, the drive motors are actuated, and the vehicle is moved forward in the direction of arrow 230 of FIG. 7. Augers 210 and 212 cut along the sides of a generally trapezoidal section immediately beneath pipeline 10 and convey this material to locations at the sides of the trench thus formed. The remaining material in the triangular sector 240 between the augers, and which does not flow and is not drawn toward the augers by evacuating the material from the sides of this sector, falls to the bottom of the trapezoidal sector. This bottom material which is missed by the front augers 210 and 212 is cut and conveyed by the rear augers 218, 220 to provide a generally trapezoidal-shaped trench beneath the pipeline.

Depending on the nature and consistency of the bottom material, deflector plates like 72 and 74, previously described, can be provided on rear auger assemblies 218 and 220.

Also, depending on bottom conditions encountered, the first augers 210, 212, can be set at a greater (or lesser) depth than the rear augers 218, 220. Further, deflector plates can be used on both the front and rear augers, so that the front auger forms a shallow trench, and the rear augers a deeper trench.

In view of the foregoing description it is believed evident that in accordance with this invention, there is provided a unique method and apparatus for entrenching elongated submerged structures and which avoids the disadvantages and shortcomings of the prior art jetting or mechanical entrenching devices.

While two preferred embodiments of an apparatus according to the invention have been shown and described, it is believed evident that changes can be made without departing from the scope of this invention.

What is claimed is:

1. Apparatus for entrenching an elongate submarine structure such as a pipe or cable comprising a vehicle having a front and a rear and adapted to be moved along the floor of a body of water;

a first auger assembly mounted at a location offset toward one side of the vehicle;

a second auger assembly mounted at a location offset toward the other side of the vehicle;

means mounting said assemblies on said vehicle for movement to a first position in which the augers are spaced apart to receive therebetween the pipeline to be entrenched, and to a second position in which the augers are inclined inwardly and lower end portions of the auger assemblies are adjacent to each other beneath the elongate structure;

motor means on said vehicle for moving said augers to said first and second positions;

each auger assembly comprising an auger having an upper portion and a lower portion;

motor means for rotating the auger;

a casing partially surrounding said lower portion to leave a front face of the auger exposed for cutting, said casing cooperating with said auger to convey bottom material toward the upper portion of the auger; and casing means substantially enclosing said upper portion and cooperating with said upper portion for conveying the material away from the trench thus formed by the augers.

2. Apparatus according to claim 1 further comprising means for connecting the lower portions of the auger assemblies together beneath the elongated structure to prevent relative fore and aft movement of the lower portions of the assemblies relative to each other.

3. Apparatus according to claim 1 further comprising brace means on said vehicle for bracing the lower end of each auger assembly.

4. Apparatus according to claim 1 further comprising roller means on said vehicle and surrounding said elongate structure when said auger assemblies are in said second position, for guiding the vehicle with respect to the elongate structure.

5. Apparatus according to claim 1 wherein each auger has a bottom end comprising cutting means for cutting downwardly into the bottom material.

6. Apparatus according to claim 1 wherein each auger assembly further comprises bearing means adjacent a lower end of the auger for supporting said lower end for rotation.

7. Apparatus according to claim 6 wherein each auger comprises a journal in the lower portion therof at a location spaced from the bottom end of the auger;

the auger has a blade which is discontinuous at said journal; and said bearing means supports said journal for rotation therein.

8. Apparatus according to claim 1 wherein said augers of said assemblies, in said second position, cut and convey bottom material from the sides of a generally trapezoidal shaped section beneath the elongated structure; and said apparatus comprises further means supported by the vehicle for further removing bottom material from beneath the elongated structure.

9. Apparatus according to claim 8 wherein said further means comprises third and fourth auger assemblies like said first and second assemblies and spaced behind said first and second assemblies.

10. Apparatus according to claim 1 further comprising deflector means on said apparatus beneath said pipeline for deflecting bottom material laterally toward said augers.

11. Apparatus according to claim 1 wherein each auger assembly further comprises discharge chute means for directing material from said upper portion of an auger to a location laterally spaced from the trench formed by the auger.

12. Apparatus according to claim 1 further comprising means mounting said auger assemblies on said vehicle for vertical adjustment to vary the depth of the trench formed by the augers.

13. Apparatus according to claim 12 comprising deflector means on said vehicle for deflecting bottom material toward said augers, and means to permit changing the height of the deflector means with respect to the augers.

14. Apparatus according to claim 12 comprising means to permit changing the length of the exposed portion of the front face of each auger.

* * * * *